US009772107B1

(12) United States Patent
Jones

(10) Patent No.: US 9,772,107 B1
(45) Date of Patent: Sep. 26, 2017

(54) WASTE OIL BURNER IMPROVED PREHEATER DESIGN

(71) Applicant: Daniel B Jones, Kalispell, MT (US)

(72) Inventor: Daniel B Jones, Kalispell, MT (US)

( * ) Notice: Subject to any disclaimer, the term of this patent is extended or adjusted under 35 U.S.C. 154(b) by 1 day.

(21) Appl. No.: 15/144,834

(22) Filed: May 3, 2016

Related U.S. Application Data

(63) Continuation of application No. 13/371,628, filed on Feb. 13, 2012, now Pat. No. 9,353,943.

(51) Int. Cl.
*F23G 5/10* (2006.01)
*F23D 11/44* (2006.01)
*H05B 1/02* (2006.01)

(52) U.S. Cl.
CPC ..... *F23G 5/10* (2013.01); *F23D 11/44* (2013.01); *H05B 1/0244* (2013.01)

(58) Field of Classification Search
CPC ..... F23D 11/386; F23D 11/44; F23D 2900/00002; F23D 2213/00; F23D 11/001; F23D 11/38; F23D 11/448; F23G 7/05; F23G 7/04; F23K 5/19; F23K 5/20; F23N 2021/04; H05B 1/0244
See application file for complete search history.

(56) References Cited

U.S. PATENT DOCUMENTS

| | | | |
|---|---|---|---|
| 4,191,214 | A | 3/1980 | Holley |
| 4,487,571 | A | 12/1984 | Robertson |
| 4,877,395 | A | 10/1989 | Schubach |
| 5,080,579 | A | 1/1992 | Specht |
| 5,341,832 | A | 8/1994 | Foust |
| 5,879,149 | A | 3/1999 | Briggs |
| 6,126,438 | A | 10/2000 | Joshi |
| 6,132,203 | A | 10/2000 | Masin |
| 2006/0127831 | A1 | 6/2006 | Kagi |
| 2008/0166673 | A1 | 7/2008 | Fedorow |

OTHER PUBLICATIONS

"U.S. Appl. No. 13/371,628 Notice of Allowance, dated Mar. 16, 2016"—9 pages.

*Primary Examiner* — Alfred Basichas
(74) *Attorney, Agent, or Firm* — Robin Kelson Consulting

(57) ABSTRACT

An improved oil preheater assembly for a waste oil burner that significantly reduces the labor time required to perform routine maintenance. This is accomplished by incorporating a removable cover to directly access the heated oil passages for cleaning thereby providing a simplified method of access to the areas most often requiring routine maintenance. Additionally this design provides an improved electrical control system which significantly reduces electrical energy consumption and the formation of oil carbonization when oil burner heat output is not required. Additionally this design incorporates a nozzle cleaning system for a low pressure siphoning type of discharge nozzle which can remove carbonization and other nozzle contamination and obstructions without the disassembly of components.

20 Claims, 5 Drawing Sheets

WASTE OIL BURNER IMPROVED PREHEATER DESIGN

CROSS REFERENCE TO RELATED APPLICATIONS

This application claims the benefit of U.S. patent application Ser. No. 13/371,628, filed Feb. 3, 2012, the disclosure of which is hereby expressly incorporated in its entirety by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The subject invention relates generally to burners used for the combustion of used or waste liquid fuels and more specifically to an improved oil preheater design incorporated into a waste oil burner.

2. Description of the Prior Art

Owners of waste oil burners are typically the generators of the waste oil. In North America alone, billions of gallons of petroleum based waste oil are generated annually. Additionally, many more gallons of vegetable based waste oil are generated each year. Both of these types of waste oils are potential fuels for use in a waste oil burner.

By properly combusting these substances, an unwanted or otherwise potentially hazardous substance can provide an economical method of heating. However, despite these benefits many waste oil burner owners have become discouraged with the complexity and frequency of basic routine maintenance services required to maintain the proper operation of current designs.

While numerous patents have been issued for waste oil burners of reasonably good operation, all waste oil burners are known to suffer from a number of disadvantages. Most waste oil burners operate in a similar manner. In order to completely and efficiently burn the waste oil, it must be pre-heated to near combustion temperatures before ignition. The formation of oil carbonization or "sludging" is an unfortunate side effect when heating waste oil to these high temperatures. This carbonization or sludging can partially clog the oil preheating passages and/or the discharge nozzle causing poor operation, or completely plug the passages and/or the discharge nozzle disabling burner operation.

In order for the burner unit to readily ignite upon a demand for heat, most prior art designs incorporate an electrical heater which is energized to keep the preheater block at near combustion temperature, even during standby periods. During normal burner operation the waste oil fuel is constantly flowing while it is being heated. The carbonization or sludging condition is worsened during periods of burner standby when no flow of the waste oil fuel exists, and yet heat is still applied by the preheater assembly. During burner standby periods, the oil contained within the preheater assembly is easily overheated if heat is continually applied. This can result in the oil burning onto the heater element or other heated surfaces increasing the formation of carbonization, and restricting or stopping the flow of oil through the heated passages, which in turn increases the frequency of maintenance services. The longer the oil preheating period is, the greater the amount of oil carbonization formed.

In these prior art designs, oil preheater assemblies are relatively large in size by comparison to the present invention. To reduce oil carbonization in these prior art designs low wattage heaters ranging from 50 to 300 watts are most commonly utilized. As a result, a long warm up period is required. Once warmed up, preheater block temperature must be maintained by keeping the heater element energized in order for the burner to ignite on demand. As a result, large cumulative amounts of electrical energy are consumed over the course of the heating season during standby periods when no heat output from the burner is required. The cost of high-temperature preheating during these standby periods reduces the economic savings potential of a waste oil burner.

Some prior art designs use an external preheater. These designs must be heated more than required for proper combustion due to the cooling of the oil that occurs as it travels from this external heater to the discharge nozzle. This design thereby increases carbonization and electrical operation cost. Some of these designs incorporate an additional heater in the nozzle discharge area further increasing burner manufacturing cost, system complexity, electrical operation cost, and maintenance requirements.

Due to the formation of carbonization, all preheater blocks must be routinely maintained by performing a cleaning procedure. Many prior art designs use multiple oil passages drilled through an aluminum block. When carbonization forms inside of these heated passages, cleaning requires extensive disassembly of components in order to access the preheater block ports with a suitable cleaning tool. Other designs use a cylindrical chamber. One of these designs incorporates an internal spiraling passage. This design is time consuming and difficult to service as it requires the waste oil burner owner or service person to clean carbonization from an internal spiraling passage which is similar in design to the internal threads of a nut for a bolt. Another cylindrical design is housed externally to the burner assembly making it somewhat easier to access than other designs; however a secondary preheater is incorporated prior to the discharge nozzle which also requires maintenance. This dual preheater design increases the manufacturing, maintenance, and operational cost of the burner.

Due to the degree of difficulty, the cleaning and maintenance procedure of oil preheater assemblies has traditionally been performed by a professionally trained service person, or by the manufacturer itself. In other cases the entire preheater assembly is replaced as routine maintenance, rather than servicing existing components further increasing maintenance and operational cost of the burner.

Most prior art preheater units are difficult to remove for service, and all are more difficult and more time consuming to directly access the heated passages or heated surfaces for cleaning than the present invention as the present invention provides an improved method of access to these heated oil passages. Another improvement of the present invention reduces the electrical energy consumption used for preheating the waste oil by turning off all electrical power to the oil preheating circuit during standby periods creating a more economical waste oil burner to operate. As an additional benefit of turning off power to the oil preheating circuit during standby periods, this design improvement also reduces the formation of carbonization caused by the excessive preheating of the waste oil fuel, thereby reducing the frequency of maintenance required creating a more desirable waste oil burner to own and operate.

A low pressure siphoning type of atomizing discharge nozzle is the type most commonly used in waste oil burners. Another improvement of the present invention incorporates a method of cleaning contamination from this type of discharge nozzle by intermittently discharging high pressure compressed air through the low pressure oil circuit of the discharge nozzle. This procedure can be performed by the operator on demand by manually pressing a button. This procedure can also be performed by incorporating an automatic system which would operate at predetermined intervals to maintain a clean nozzle.

The present invention incorporates a simplified design which does not require the time consuming nor complicated disassembly of prior art waste oil burners when performing routine maintenance. This allows the waste oil burner owner to quickly and easily perform the routine maintenance him or herself. The design of the present invention reduces electrical energy consumption and the formation of carbonization. The present invention utilizes a method of cleaning the low pressure siphoning type of discharge nozzle without the need for component removal or disassembly. As a result, the present invention creates a more desirable waste oil burner to own and operate as prior art designs have a significantly higher cost of ownership than the present invention.

Reference to Bender U.S. Pat. No. 5,067,894 dated Nov. 26, 1991

A slide out preheater block design makes removal of the preheater as an assembly quite fast. However, disassembly of the unit for oil passage cleaning is quite difficult. The slide out preheater block unit incorporates a complex system of wiring and related controls which must be completely disassembled requiring a great deal of system knowledge and time in order to perform routine preheater block maintenance services. The drilled passage preheater block design requires removal of steel plugs which are often seized into the aluminum block. Once the plugs are removed, the drilled passages require a time consuming method of brushing before the reassembly process can be performed.

During the heating season, an electrical heater is energized to keep the preheater block warmed up so that the waste oil burner is ready to ignite upon a demand for heat. The heater is energized even during standby periods, increasing the formation of carbonization and consuming large amounts of electrical energy over the course of the heating season. This design additionally increases carbonization formation because the waste oil comes into direct contact with the surface of the heater element resulting in more frequent nozzle clogs. When nozzle clogging occurs access to the nozzle for nozzle removal and cleaning is required.

Reference to Kagi patent application Ser. No. 10,715,079 dated Dec. 13, 2004

This design incorporates the preheater block as a more integral and structural component of the overall burner unit itself. The preheater block is not easily removed for service and requires disassembly of almost the entire burner assembly including a complex system of wiring and related controls. This requires a great deal of system knowledge and time in order to perform routine preheater block maintenance services.

During standby periods, an "air" heater element contained within the preheater block assembly is always on, consuming large amounts of electrical energy over the course of the heating season. During burner operation this design energizes an additional heater element that is in direct contact with the waste oil. This design increases carbonization formation because the oil comes into direct contact with the surface of the oil heater element resulting in more frequent nozzle clogs. When nozzle clogging occurs access to the nozzle for nozzle removal and cleaning is required.

Reference to Briggs U.S. Pat. No. 5,879,149 dated Mar. 9, 1999

This design uses an external cylindrical style oil preheater with an additional preheater located near the discharge nozzle. Both preheaters require periodic maintenance services. The use of two separate preheater assemblies adds to the complexity and cost of manufacturing, as well as adding to the complexity and time required for routine maintenance services.

Throughout the heating season the external cylindrical preheater is energized, during both operational and standby periods, consuming large amounts of electrical energy over the course of the heating season. Because the oil is heated during standby times when the oil remains in the preheater rather than flowing through it, this design increases carbonization formation resulting in more frequent nozzle clogs. When nozzle clogging occurs access to the nozzle for nozzle removal and cleaning is required.

Reference to Schubach U.S. Pat. No. 4,877,395 dated Oct. 31, 1989

This design uses cylindrical style oil preheater with an internal spiraling oil passage. The preheater assembly is incorporated into the burner assembly as an integral component which is not easily removed for disassembly and service. This type of preheater is also difficult to clean due to the internal spiraling "threaded" style of oil passage design.

Throughout the heating season the preheater is always energized, during both operational and standby periods, consuming large amounts of electrical energy over the course of the heating season. Because the oil is heated during standby times when the oil remains in the preheater rather than flowing through it, this design increases carbonization formation resulting in more frequent nozzle clogs. When nozzle clogging occurs access to the nozzle for nozzle removal and cleaning is required.

Reference to Specht U.S. Pat. No. 5,080,589 dated Jan. 14, 1992

This design uses a dual oil preheater system. A "secondary heater" is energized to maintain oil temperature at or near combustion temperature during standby periods. A "primary heater" is energized during burner ignition periods.

The use of two separate preheater assemblies increases the complexity and cost of manufacturing, as well as adding to the complexity and time required for routine maintenance services.

Throughout the heating season the "secondary" preheater is energized during standby periods, consuming large amounts of electrical energy over the course of the heating season. Because the oil is heated during standby times when the oil remains in the preheater rather than flowing through it, this design increases carbonization formation resulting in more frequent nozzle clogs.

When nozzle clogging occurs access to the nozzle for nozzle removal and cleaning is required.

Reference to Foust U.S. Pat. No. 5,341,832 dated Aug. 30, 1994

During preheating cycles this design incorporates a complex pre-burn and post-burn waste oil fuel circulation and filtering system which increases burner manufacturing cost. It is intended to reduce, but not eliminate, the frequency of preheater block cleaning. This design adds to system complexity and increases the level of difficulty in performing routine maintenance services. Because the oil supply pump operates during the preheating and post-burn cycles this design increases electrical operation cost. While a reduction in the formation of carbonization was achieved the benefit was out-weighed by the additional manufacturing and operational cost.

Disassembly of the unit for oil passage cleaning is quite difficult. The preheater block unit incorporates a complex system of passages, wiring, and related controls which must be disassembled, requiring a great deal of system knowledge and time in order to perform routine preheater block maintenance services. The drilled passage preheater block design requires removal of plugs to access passages for cleaning. Once the plugs are removed, the drilled passages require a time consuming method of brushing before the reassembly process can be performed.

When nozzle clogging occurs access to the nozzle for nozzle removal and cleaning is required.

Reference to Masin U.S. Pat. No. 6,132,203 dated Oct. 17, 2000

Instead of using a low pressure siphoning type of atomizing discharge nozzle, this prior art design uses a specially designed high pressure discharge nozzle with a wire mesh strainer incorporated into the nozzle. A purging air line is incorporated into the high pressure nozzle assembly allowing the strainer to be cleaned by back flushing with air into a separate blowdown tank which then requires draining and/or cleaning. Nozzle contamination and wear is increased in waste oil burning devices due to the heavy metal and other contamination contained within the waste oil fuel. Most manufacturers of waste oil burners use a low pressure siphoning type of atomizing discharge nozzle which offers more resistance to clogging and can pass higher viscosity waste oils, requiring less preheating, due to the larger discharge orifice. A high pressure nozzle uses a smaller discharge orifice than a low pressure siphoning type of nozzle and therefore is more prone to both clogging and nozzle wear requiring more frequent cleaning and/or replacement.

By using a specially designed high pressure nozzle, the cost of manufacturing and maintenance is increased in this prior art design. The smaller discharge orifice of a high pressure nozzle requires a lighter viscosity fuel for proper flow and atomization requiring higher preheating temperatures to further reduce waste oil fuel viscosity than a siphoning type of nozzle. Higher preheater temperatures result in more carbonization forming in the preheater assembly and higher electrical operation cost. The preheater of this prior art design is energized even during standby periods, further increasing the formation of carbonization and consuming large amounts of electrical energy over the course of the heating season.

BRIEF SUMMARY OF THE INVENTION

The present invention proposes an improved preheater block design that incorporates a removable cover plate directly over the heated oil passages. Removal of the preheater block's cover plate provides complete access to the oil heating passages for fast, efficient cleaning, simplifying routine maintenance tasks. Service complexity and time is further reduced by locating the preheater block completely within the waste oil burner's blast (or air delivery) tube. When housed in this location the preheater block design of the present invention makes it unnecessary to disassemble the more complex electrical control systems to perform routine maintenance. The present invention design offers a less time consuming and simplified maintenance service that is within the ability of most waste oil burner owners to perform themselves, thereby further reducing the costs of ownership and creating a more desirable waste oil burner to own and operate.

The present invention provides a design which heats up very quickly and as such does not require the preheater to be energized during standby periods. The heating circuit is electronically controlled by a programmable digital temperature controller which allows the burner to be used with petroleum or vegetable based waste oils. During burner standby periods power consumption is reduced to less than five watts as the digital temperature controller is the only component consuming power during this time.

When a demand for heat exists, the contact points of the thermostat close completing the electrical circuit required to energize a high voltage relay which then provides power to the preheater and other required circuits. A powerful high wattage heater element that does not come in direct contact with the oil is capable of providing fast preheater block warm-ups. Optimum preheater block temperature is quickly obtained and the burner ignites. Once warmed to the proper temperature, the system will cycle the heater element on and off as needed to maintain it. When a demand for heat is satisfied, the room thermostat or boiler aquastat opens the circuit to the high voltage relay and the preheater block oil heating circuits are turned off. The preheater block temperature drops below an acceptable level and the burner turns off until the next demand for heat output when the process repeats.

This design makes it unnecessary to maintain the waste oil at near to combustion temperatures during standby times when oil burner heat output is not required, therefore oil heating circuits can be turned off without negatively affecting overall burner operation. Since oil heating circuits are turned off during standby times a significant reduction in both energy consumption and the formation of oil carbonization is achieved without the use of a complex preheater oil circulation and filtering system. Additional reductions in the formation of oil carbonization are achieved by utilizing a non-direct method of preheating the waste oil fuel whereby the oil does not come into direct contact with a heater element.

When the low pressure siphoning type of nozzle requires cleaning, compressed air is briefly injected into the waste oil fuel supply circuit prior to the fuel entering the nozzle. The present invention blows the contamination directly through the nozzle orifice and does not require the use of a blowdown tank or the additional cleaning of such a device. This clears carbonization and other types of nozzle contamination without the need for nozzle removal or other component disassembly thereby further reducing maintenance time and cost and creating a more desirable waste oil burner to own and operate.

When compared to prior art, the present invention incorporates a simplified design which keeps manufacturing cost low and allows routine maintenance tasks to be quickly and easily performed by the waste oil burner owner thereby reducing the costs of ownership and creating a more desirable product to own and operate.

BRIEF DESCRIPTION OF THE DRAWINGS

A more complete understanding of the present invention may be had from the following detailed description, particularly when considered in light of the accompanying drawings, wherein.

DETAILED DESCRIPTION OF THE DRAWINGS

As noted above, this invention relates to waste oil burners. In particular, this invention relates to an improved preheater system for waste oil burners which minimizes the time required for routine cleaning maintenance of preheater waste oil fuel supply passages, significantly reduces the electrical consumption of the heating circuit during standby periods (or periods where no demand for burner gun heat output exist), and provides a method for cleaning a low pressure siphoning type of discharge nozzle without nozzle removal.

Figure 1:
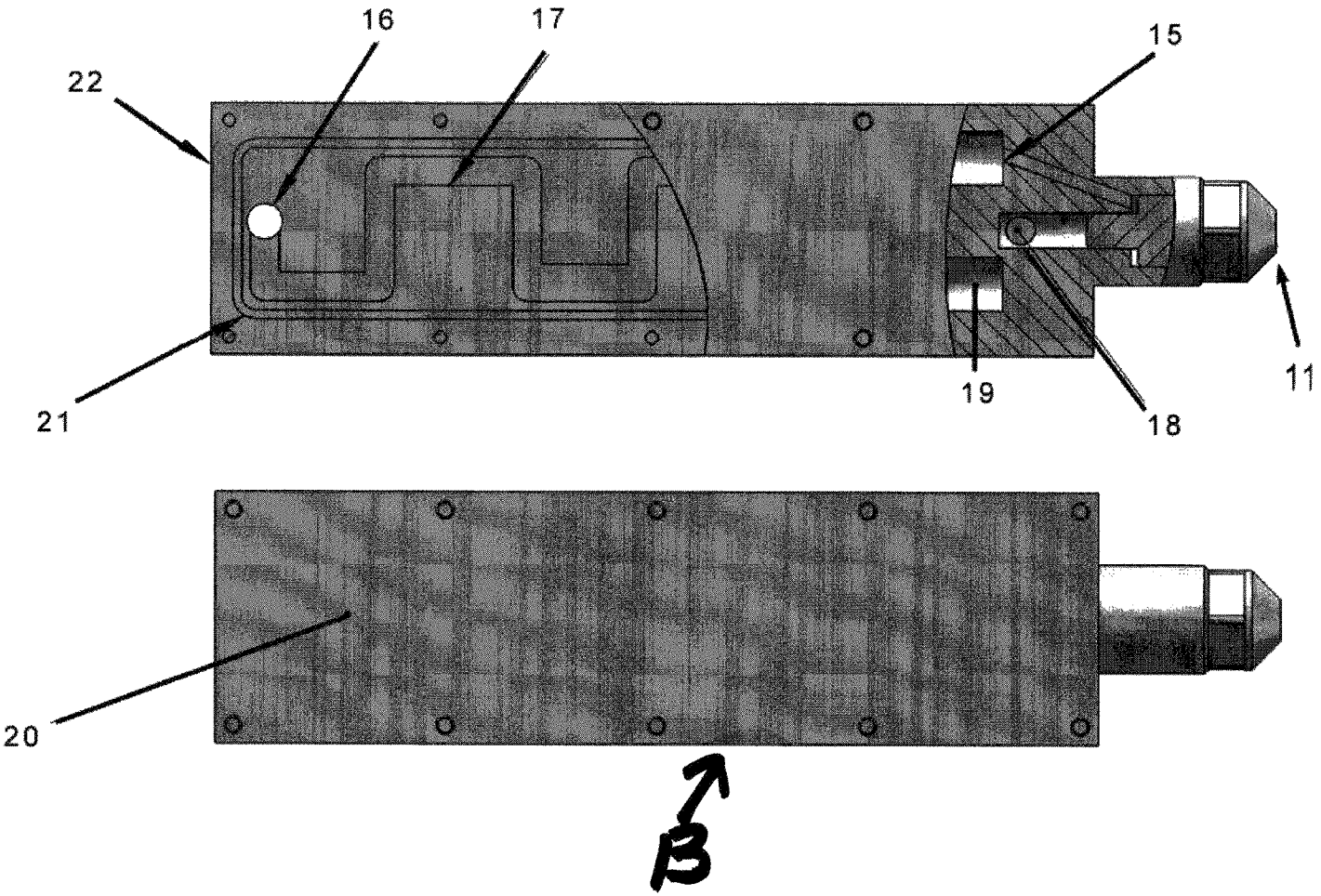
FIG. 1 is a schematic view of a waste oil preheater block with a removable cover to access oil passages for cleaning.

Referring now to FIG. 1, there is shown a waste oil burner preheater block 13 with a removable cover plate 20 for access to cleaning the block passages 17, which are heated by a cartridge type heater element 19, through which the waste oil fuel flows and is heated non-directly by the heater element 19 prior to discharge from the nozzle 11. To prevent leakage of the waste oil fuel the removable cover plate 20 is sealed to the block with a suitable material. A groove 21 may be incorporated into the block 13 and/or the cover plate 20 to hold a suitable sealing material. In standby (or no demand for heat modes) the preheater block 13 is not electrically heated and remains at ambient temperature. When a demand for heat is present the preheater block 13 electrical heating circuits energize the heating element 19 and the preheater block 13 is quickly brought up to a temperature to achieve atomization of the waste oil fuel during discharge from the nozzle 11 required for proper combustion. Approximately two minutes is required to increase the block 13 temperature from room temperature to 160 degrees Fahrenheit. The waste oil fuel to be heated enters at location 16, is heated as it travels through passage 17, enters the nozzle at location 18, and is atomized as it mixes with compressed air during discharge from the nozzle 11. The compressed air for atomization enters the rear of the preheater block 13 at location 22 where it travels through the block to location 15 to enter the nozzle 11 prior to the discharge port. The mixture is ignited with a spark producing transformer and electrodes (not shown). To clean a clogged nozzle compressed air is briefly re-routed using a solenoid valve (indicated by item 27 on FIG. 5) and/or check valve system and piping (not shown) to enter the oil passage as close to location 18 as possible. Waste oil fuel pressure within the heated passageways normally does not exceed 10 psi. This brief introduction of air pressure supplied at pressures up to 175 psi will clear nozzle clogs without the need to physically remove the nozzle and clean it. Further more detailed description of these components and their function is not required as those who are skilled in the art of designing and manufacturing waste oil burners are familiar and knowledgeable about them.

Figure 2:
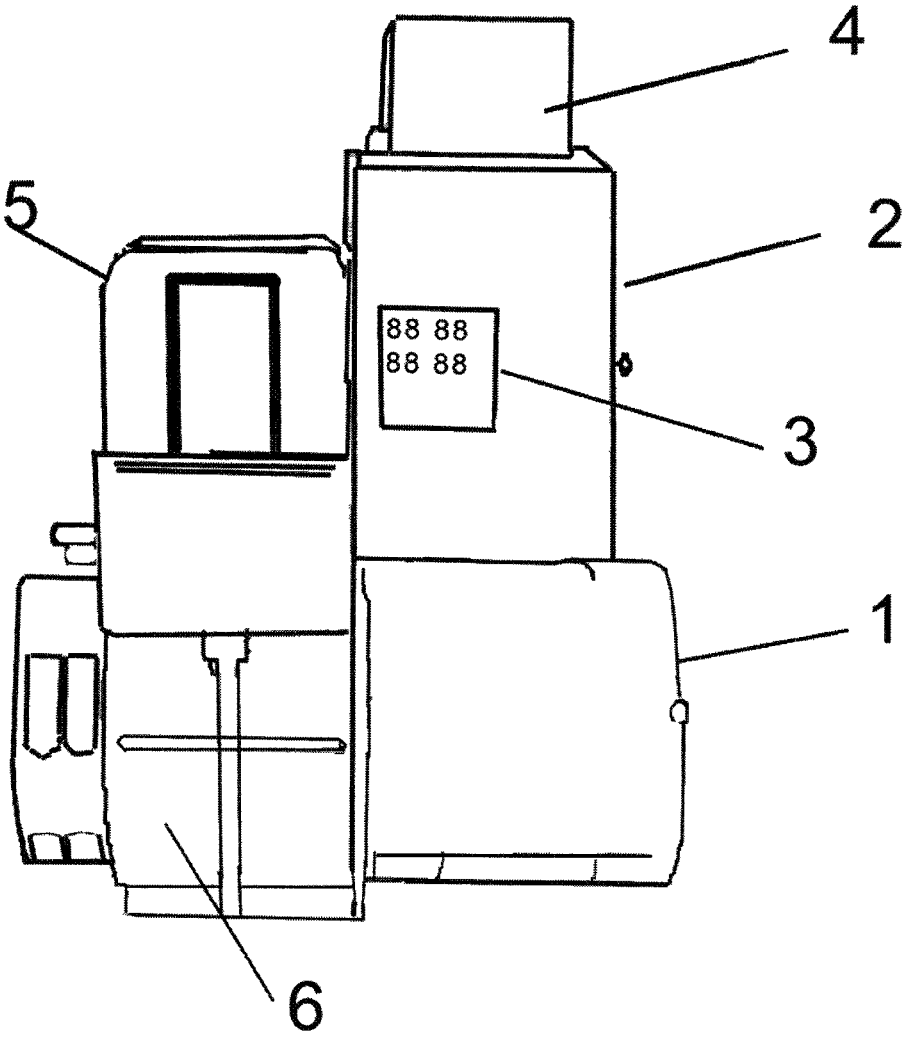
FIG. 2 is a schematic rear view of an oil burner gun modified with the addition of an electrical control box to house the electrical components required for control of the preheater block heating system.

Referring now to FIG. 2, there is shown a rear view of a typical fuel oil burner assembly. Pictured are the following components; combustion air motor 1, a primary or safety controller 4, an ignition transformer 5, fuel oil burner housing 6. Further more detailed description of these components and their function is not required as those who are skilled in the art of designing and manufacturing waste oil burners are familiar and knowledgeable about them. Fuel oil burner assemblies of this type are recognized by those skilled in the art as that which are typically modified by waste oil burner manufacturers in order to use waste oil as a fuel. Fuel oil burner assemblies of this type when used with the present invention can be used to burn waste oil as a fuel. FIG. 2 shows such a fuel oil burner which has been modified with the addition of a box 2 in which to house the additional electrical components required for the operation of the preheater block electrical circuits. Item 3 refers to one possible location of the digital temperature controller used in the present invention to maintain the preheater block temperature at the desired temperature when a demand for heat is called for by the system thermostat or aqua-stat (indicated by item 35 on FIG. 5).

Figure 3:
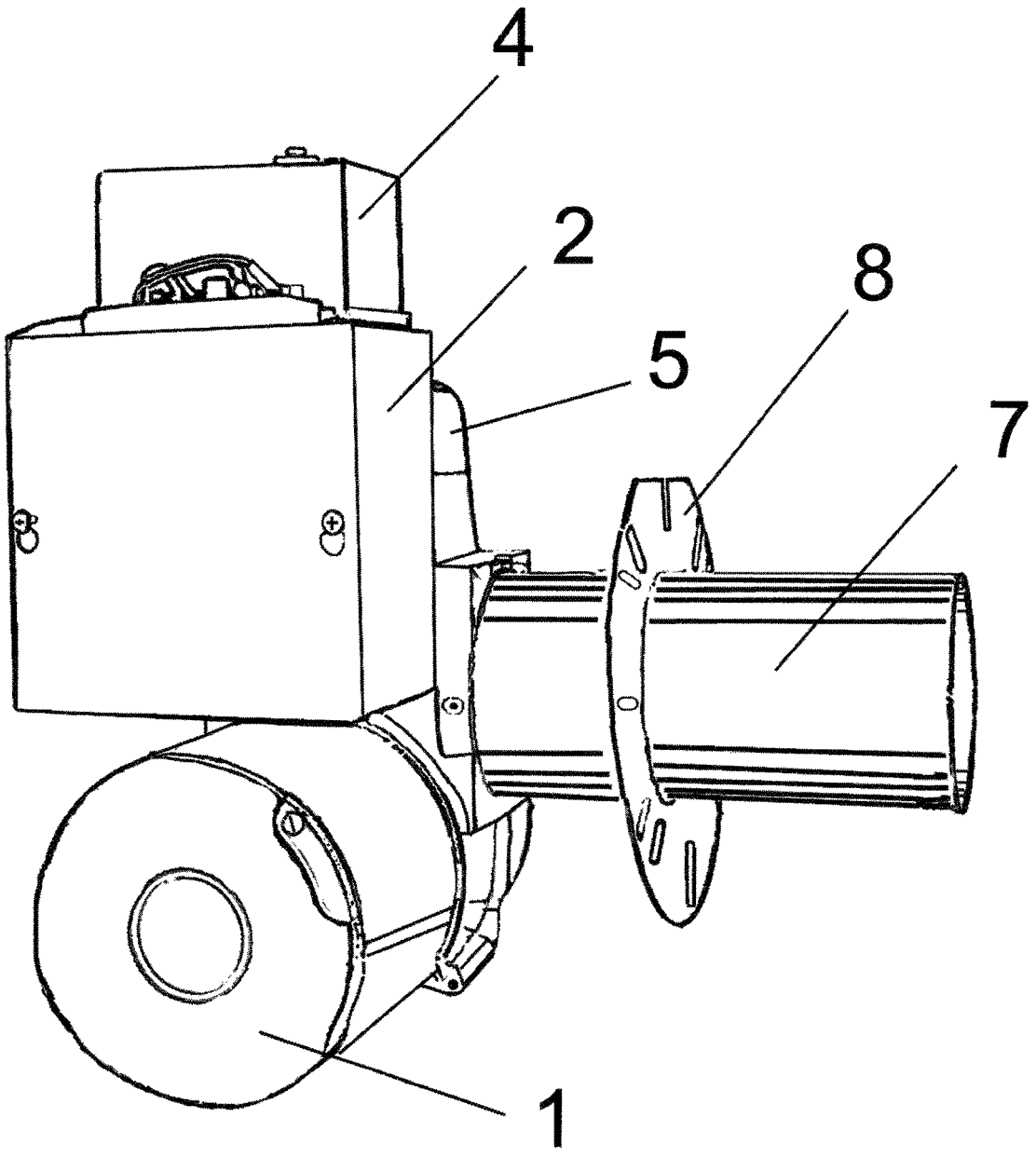
FIG. 3 is a schematic side view of an oil burner gun.

Referring now to FIG. 3, there is shown a side view of a typical fuel oil burner assembly. Pictured are the following components; combustion air motor 1, a primary or safety controller 4, an ignition transformer 5, a blast or combustion air delivery tube 7, a mounting flange for mounting a burner to a furnace or boiler 8. Item 2 refers to a box which has been added on to the standard fuel oil burner in which to house the additional electrical components required for the operation of the preheater block electrical circuits.

Figure 4:
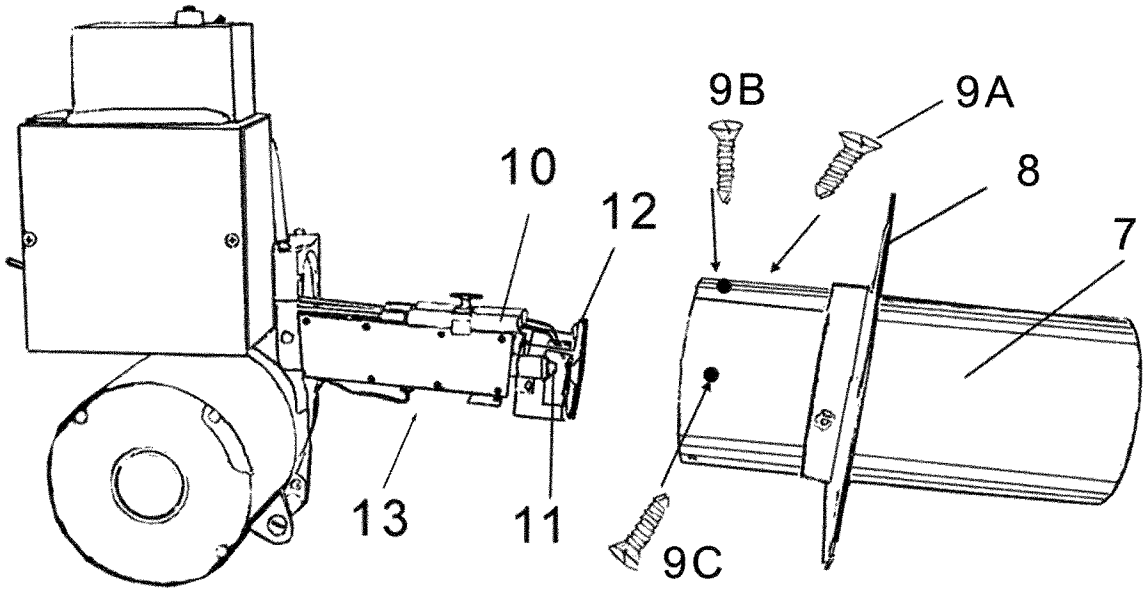
FIG. 4 is a schematic side view of an oil burner gun with the blast tube removed showing the preheater block equipped with a removable cover plate.

Referring now to FIG. 4, there is shown a side view of a converted for waste oil use fuel oil burner assembly which has been partially disassembled for access to the preheater block 13 of the present invention. Pictured are the following components; 7 blast or combustion air delivery tube, 8 mounting flange for mounting burner to furnace or boiler, 9A, 9B, and 9C screws used to retain the blast tube 7 onto the fuel oil burner housing (item 6 of FIG. 2), electrodes 10 used to transfer spark from transformer (see item 5 of FIGS. 2) to 11 the nozzle discharge ignition area, the flame retention head or combustion air turbulator 12, and the waste oil fuel preheater block 13 of the present invention.

Figure 5:
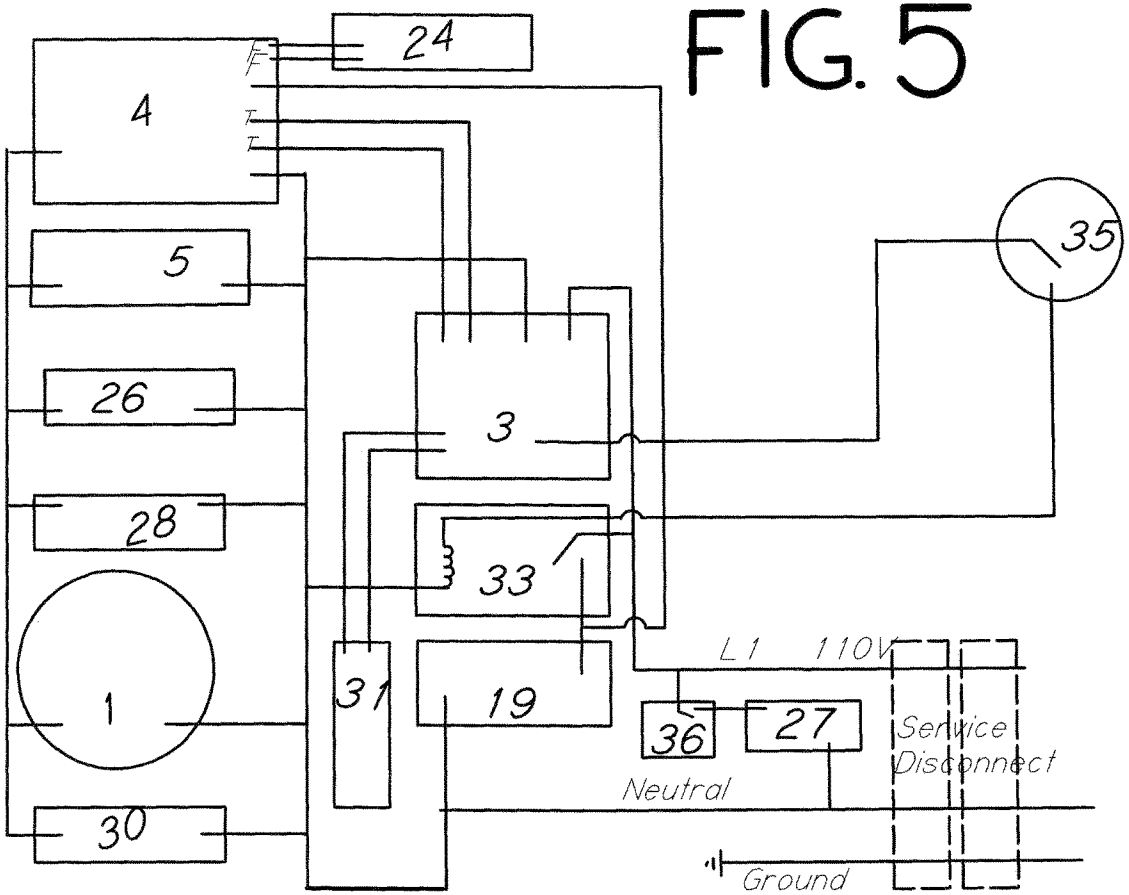
FIG. 5 is a simplified block wiring schematic detailing the improved electrical control system design which reduces electrical energy consumption.

Referring now to FIG. 5, there is shown a simplified block wiring schematic of the present invention detailing the improved electrical control system design which reduces electrical energy consumption during standby periods where no heat output from the burner is required. Room thermostat or boiler aquastat 35 provides a demand for heat signal to turn burner heating and control circuits on. Power control relay 33 is used to provide power to cartridge heater element 19 and primary safety controller 4 when a call for heat has been recognized by the thermostat or aquastat 35. Pictured are the following components; primary safety controller 4 used to provide power to oil solenoid 26 and primary compressed air solenoid 28, ignition transformer 5, combustion air motor 1, and hour meter 30, only when a call for heat has been recognized by the thermostat or aquastat 35. The cad cell flame sensor 24 is monitored by the primary controller 4 to shut down the burner should a flame failure occur. Ignition transformer 5 provides a spark to ignite the waste oil fuel and air mixture. Primary compressed air solenoid 28 controls the flow of atomization air at the nozzle. Secondary compressed air solenoid 27 is used during the air pressure nozzle cleaning process operated by switch 36. Oil solenoid 26 is used for control of waste oil fuel flow into the preheater block. Oil solenoid 26 may also be used during the air pressure nozzle cleaning process to limit the direction of air pressure flow through the nozzle. A mechanical one-way check valve could be substituted for this purpose. Motor 1 provides combustion air, hour meter 30 records accumulated burner on time, and thermocouple type temp sensor 31 attached to the preheater block (see FIG. 4 item 13) provides a preheater block temperature signal to the digital temperature controller 3. Digital temperature controller 3 is a programmable electronic control device which will maintain preheater block 13 temperature at a pre-determined point when a call for heat has been recognized by the thermostat or aquastat 35. Further more detailed description of these components and their function is not required as those who are skilled in the art of designing and manufacturing waste oil burners are familiar and knowledgeable about them.

What I claim:

1. An electrical control system for providing on-demand heat to a waste oil burner preheater block having a heating element in operational association with the block and an internal winding passageway for delivering oil, the system comprising:

(a) means for receiving from a user a desired minimum preheater block temperature for oil burner ignition;

(b) means for receiving a first trigger signal for heat;

(c) transmitting means for powering the heating element associated with the preheater block in response to the signal;

(d) means for monitoring the temperature of the preheater block;

(e) transmitting means for powering ignition of the oil burner when the preheater block has reached the desired temperature;

(f) means for receiving a second trigger signal that the call for heat has been satisfied, and (g) transmitting means for terminating power to the heating element, such that the preheater block can cool to an ambient temperature.

2. The electrical control system of claim 1 wherein the preheater block temperature monitoring means comprises a temperature sensor in operational association with the preheater block.

3. The electrical control system of claim 1 wherein the means for receiving a desired minimum preheater temperature block temperature comprises a programmable digital temperature controller.

4. The electrical control system of claim 1 wherein the first trigger signal is from an ambient thermostat or boiler aquastat.

5. The electrical control system of claim 1 wherein the second trigger signal is from an ambient thermostat or boiler aquastat.

6. The electrical control system of claim 1 wherein the heating element can produce more than about 300 watts.

7. The electrical control system of claim 1 further comprising transmitting means for directing the delivery of compressed gas to the preheater block on demand.

8. A method for providing on-demand heat to an oil burner preheater block, the method comprising the steps of:

(a) an electrical control system receiving from a user a desired minimum preheater block temperature for oil burner ignition, the control system being in operational association with a temperature sensor and a heating element in operational association with the preheater block;

(b) the electrical control system receiving a first trigger signal for heat;

(c) the electrical control system transmitting power to the heating element in response to the first trigger signal;

(d) the electrical control system receiving temperature data from the temperature sensor;

(e) the electrical control system transmitting power for igniting the oil burner when the preheater block has reached the desired minimum temperature; and (f) the electrical control system terminating power to the heating element in response to a second trigger signal that the call for heat has been satisfied.

9. The method of claim 8 wherein the first and second trigger signals occur sequentially.

10. The method of claim 8 wherein the first trigger signal is from an ambient thermostat or boiler aquastat.

11. The method of claim 8 wherein the second trigger signal is from an ambient thermostat or boiler aquastat.

12. The method of claim 8 wherein a programmable digital temperature controller receives the desired minimum preheater block temperature.

13. The method of claim 8 wherein the heating element can produce more than about 300 watts.

14. The method of claim 8 comprising the additional step of directing the delivery of compressed gas to the preheater block on demand.

15. The method of claim 14 wherein the delivery of compressed gas occurs prior to igniting the oil burner.

16. The method of claim 8 wherein the electrical control system consumes less than about 5 watts of power in the absence of the first trigger signal.

17. A method for reducing oil carbonization forming in an oil burner preheater block, the method comprising the steps of:

an electrical control system receiving from a user a desired minimum preheater block temperature for oil burner ignition, the control system being in operational association with a temperature sensor and a heating element in operational association with the preheater block;

the electrical control system receiving a first trigger signal for heat;

the electrical control system transmitting power to the heating element in response to the first trigger signal;

the electrical control system receiving temperature data from the temperature sensor;

the electrical control system transmitting power for igniting the oil burner when the preheater block has reached the desired minimum temperature; and the electrical control system terminating power to the heating element in response to a second trigger signal that the call for heat has been satisfied.

18. The method of claim 17 wherein a programmable digital temperature controller receives the desired minimum preheater block temperature.

19. The method of claim 17 comprising the additional step of directing the delivery of compressed gas to the preheater block on demand.

20. The method of claim 17 wherein at least one of the trigger signals is from an ambient thermostat or boiler aquastat.

* * * * *